US012162654B2

(12) United States Patent
Valencia

(10) Patent No.: US 12,162,654 B2
(45) Date of Patent: Dec. 10, 2024

(54) PAPER TRAY HAVING DIVIDED COMPARTMENTS WITH BI-FOLD CORNER WEBS

(71) Applicant: WESTROCK SHARED SERVICES, LLC, Atlanta, GA (US)

(72) Inventor: John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 251 days.

(21) Appl. No.: 17/600,042

(22) PCT Filed: Mar. 27, 2020

(86) PCT No.: PCT/US2020/025188
§ 371 (c)(1),
(2) Date: Sep. 29, 2021

(87) PCT Pub. No.: WO2020/205503
PCT Pub. Date: Oct. 8, 2020

(65) Prior Publication Data

US 2022/0185532 A1 Jun. 16, 2022

Related U.S. Application Data

(60) Provisional application No. 62/826,582, filed on Mar. 29, 2019.

(51) Int. Cl.
*B65D 5/4805* (2006.01)
*B65D 5/36* (2006.01)
(Continued)

(52) U.S. Cl.
CPC ..... *B65D 5/48022* (2013.01); *B65D 5/3642* (2013.01); *B65D 5/4266* (2013.01); *B65D 85/36* (2013.01)

(58) Field of Classification Search
CPC ..... B65D 5/48022; B65D 5/3642; B65D 5/4266; B65D 85/36; B65D 5/3657;
(Continued)

(56) References Cited

U.S. PATENT DOCUMENTS 3,721,380 A * 3/1973 Meyers ..... B65D 5/28 229/120.17
3,876,132 A 4/1975 Kuchenbecker
(Continued)

FOREIGN PATENT DOCUMENTS

DE 2236804 A1 2/1974
DE 9401595 U1 3/1994
FR 2741923 A1 6/1981

*Primary Examiner* — Christopher R Demeree
(74) *Attorney, Agent, or Firm* — Brian J. Goldberg; Rohini K. Garg

(57) ABSTRACT

A tray including first and second compartment portions each having a bottom panel, a first side panel foldably connected to a first side edge of the bottom panel, a second side panel foldably connected to a second side edge of the bottom panel, a front panel foldably connected to a front edge of the bottom panel and a rear panel foldably connected to a rear edge of the bottom panel, wherein a side edge of the front panel and a front edge of the second side panel are connected to one another by a front bi-fold corner web panel and a side edge of the rear panel and a rear edge of the second side panel are connected to one another by a rear bi-fold corner web panel.

19 Claims, 8 Drawing Sheets

(51) Int. Cl.
*B65D 5/42* (2006.01)
*B65D 85/36* (2006.01)

(58) Field of Classification Search
CPC .... B65D 5/2047; B65D 5/248; B65D 5/6626; B65D 5/241; B65D 5/48002; B65D 5/48034
USPC ..... 229/117, 120.17, 186, 117.07, 407, 919; 493/912
See application file for complete search history.

(56) References Cited

U.S. PATENT DOCUMENTS 4,944,451 A * 7/1990 Forbes, Jr. ..... B65D 5/48022 229/114
5,009,363 A * 4/1991 Zavatone ..... B65D 5/48022 229/120.16
D332,393 S * 1/1993 Boone ..... D9/760
5,326,017 A 7/1994 Yuan-Shin et al.
5,855,315 A * 1/1999 Roseth ..... B65D 5/5495 229/120.04
5,908,152 A * 6/1999 Tullis ..... B65D 5/2047 229/148
6,471,121 B1 * 10/2002 Nielsen ..... B65D 5/48022 229/120.16
9,073,662 B2 * 7/2015 Flaming ..... B65D 5/48002

* cited by examiner

PAPER TRAY HAVING DIVIDED COMPARTMENTS WITH BI-FOLD CORNER WEBS

BACKGROUND OF THE INVENTION

1. Field of the Invention

The subject invention is directed to product packaging, and more particularly, to a paper tray having divided compartments with bi-fold corner webs, which is adapted and configured to be erected manually or by a machine from a flattened condition.

2. Description of Related Art

Currently, trays having divided compartments for packaging products such as cookies and the like, are made from plastic materials. This presents an environmental issue, since plastic products are not fully recyclable.

It would be beneficial therefore, to provide compartmented trays that are made from paper board materials, which are fully recyclable and safe for the environment. It would also be beneficial to provide compartmented trays that are made from paper board materials and that can be erected either manually or by a machine from a flattened condition. This would enable a plurality of trays to be shipped together in a bulk container to a packaging facility where they can be subsequently separated and erected.

The subject invention provides such a solution by providing a die cut paper board blank that can be formed into a tray having two or more divided compartments with bi-fold corner webs, which can be erected manually or by machine from a flattened condition.

SUMMARY OF THE DISCLOSURE

The subject invention is directed to a divided tray for food products that has at least two compartments and to a die cut paper board blank for constructing such a tray. The blank includes a first compartment portion having a bottom panel, a first side panel foldably connected to a first side edge of the bottom panel, a second side panel foldably connected to a second side edge of the bottom panel, a front panel foldably connected to a front edge of the bottom panel and a rear panel foldably connected to a rear edge of the bottom panel. A side edge of the front panel and a front edge of the second side panel are connected to one another by a front bi-fold corner panel and a side edge of the rear panel and a rear edge of the second side panel are connected to one another by a rear bi-fold corner panel.

The blank further includes a second compartment portion having a bottom panel, a first side panel foldably connected to a first side edge of the bottom panel and foldably connected to the second side panel of the first compartment portion along an adjoining fold line, a second side panel foldably connected to a second side edge of the bottom panel, a front panel foldably connected to a front edge of the bottom panel and a rear panel foldably connected to a rear edge of the bottom panel. A side edge of the front panel and a top edge of the first side panel are connected to one another by a front bi-fold corner panel and a side edge of the rear panel and a rear edge of the first side panel are connected to one another by a rear bi-fold corner panel.

In an embodiment having two compartment portions, the first side panel of the first compartment portion has front and rear glue tabs foldably connected to respective front and rear edges thereof for securement to interior surfaces of the front and rear panels of the first compartment portion, and the second side panel of the second compartment portion has front and rear glue tabs foldably connected to respective front and rear edges thereof for securement to interior surfaces of the front and rear panels of the second compartment portion. In addition, a panel portion of each bi-fold corner panel that is foldably connected to a side panel serves as a glue tab with respect to an interior surface of that side panel.

In an embodiment of the invention, the blank includes a third compartment portion having a bottom panel, a first side panel foldably connected to a first side edge of the bottom panel, a second side panel foldably connected to a second side edge of the bottom panel and foldably connected to the first side panel of the first compartment portion along an adjoining fold line, a front panel foldably connected to a front edge of the bottom panel and a rear panel foldably connected to a rear edge of the bottom panel, wherein a side edge of the front panel and a front edge of the second side panel are connected to one another by a front bi-fold corner panel and a side edge of the rear panel and a rear edge of the second side panel are connected to one another by a rear bi-fold corner panel.

In an embodiment having three compartment portion, a second side edge of the front panel of the first compartment portion and a front edge of the first side panel of the first compartment portion are connected to one another by a front bi-fold corner panel and a second side edge of the rear panel and a rear edge of the first side panel of the first compartment portion are connected to one another by a rear bi-fold corner panel. A panel portion of each bi-fold corner panel that is foldably connected to an edge of a side panel serves as a glue tab with respect to an interior surface of that side panel. In addition, the first side panel of the third compartment portion has front and rear glue tabs foldably connected to respective front and rear edges thereof for securement to interior surfaces of the front and rear panels of the third compartment portion.

These and other features of the compartmented trays of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the compartmented trays of the subject invention without undue experimentation, preferred embodiments thereof will be described in detail herein below with reference to the figures wherein.

DETAILED DESCRIPTION OF THE PREFERRED EMBODIMENTS

Figure 1:
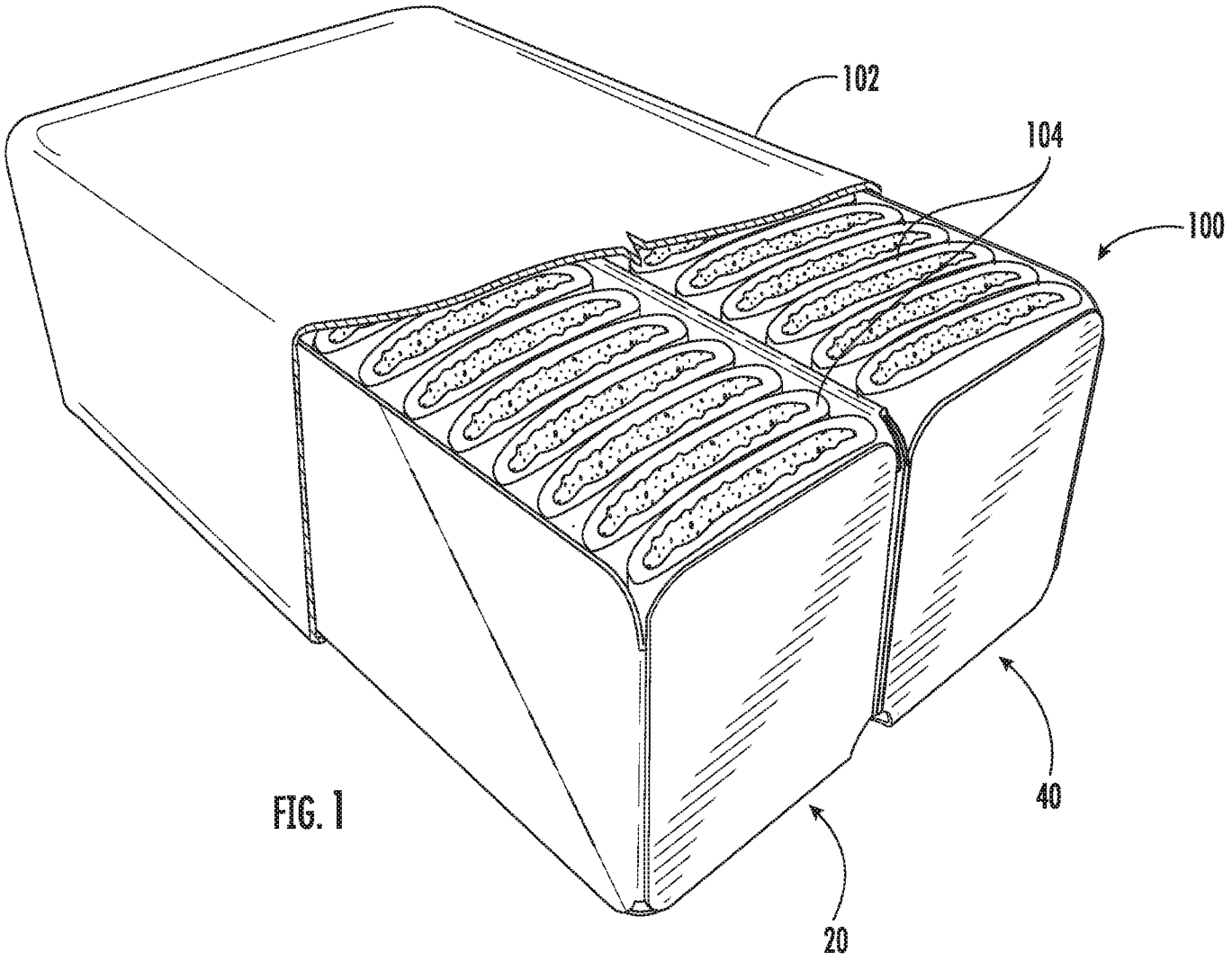
FIG. 1 is a perspective view of an embodiment of the tray of the subject invention, which has two divided compartments, and which is shown containing products and enclosed within a package.

Referring now to the drawings wherein like reference numerals identify similar structural features or elements of the subject invention, there is illustrated in FIG. 1 a compartmented tray 100 contained within a packaging enclosure 102 and having two compartment portions 20, 40 for packaging food products such as cookies 104 or the like, and which is adapted and configured to be. The compartmented tray 100 can be erected manually or by a machine using a die cut paper or paperboard blank 10, which is illustrated in FIG. 2.

Figure 2:
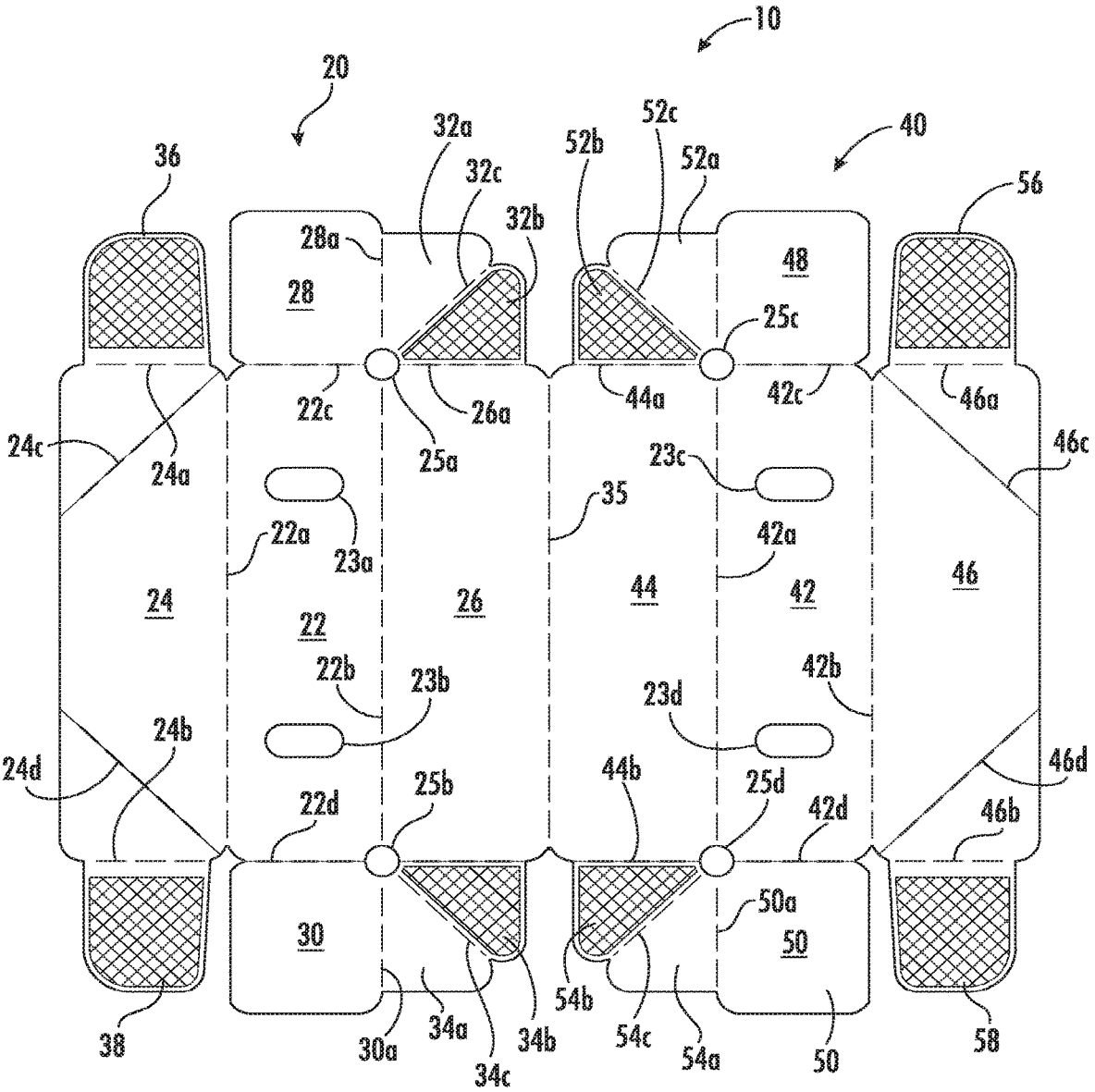
FIG. 2 is a top plan view of a blank for forming the tray of FIG. 1.

Referring to FIG. 2, the blank 10 includes first compartment portion 20 which has a bottom panel 22, a first side panel 24 foldably connected to a first side edge 22*a* of the bottom panel 22, a second side panel 26 foldably connected to a second side edge 22*b* of the bottom panel 22, a front panel 28 foldably connected to a front edge 22*c* of the bottom panel 22 and a rear panel 30 foldably connected to a rear edge 22*d* of the bottom panel 22.

A side edge 28*a* of the front panel 28 and a front edge 26*a* of the second side panel 26 are connected to one another by a front bi-fold corner web panel 32*a*, 32*b* separated by an angled fold line 32*c*. Similarly, a side edge 30*a* of the rear panel 30 and a rear edge 26*b* of the second side panel 26 are connected to one another by a rear bi-fold corner web panel 34*a*, 34*b* separated by an angled fold line 34*c*. In compartment portion 20, the front corner panel portion 32*b* and the rear corner panel portion 34*b* serve as glue tabs for securement to the interior surface of side panel 26.

The second compartment portion 40 of blank 10 has a bottom panel 42, a first side panel 44 foldably connected to a first side edge 42*a* of the bottom panel 42 and foldably connected to the second side panel 26 of the first compartment portion 20 along an adjoining fold line 35, a second side panel 46 foldably connected to a second side edge 42*b* of the bottom panel 42, a front panel 48 foldably connected to a front edge 42*c* of the bottom panel 42 and a rear panel 50 foldably connected to a rear edge 42*d* of the bottom panel 42.

A side edge 48*a* of the front panel 48 and a top edge 44*a* of the first side panel 44 are connected to one another by a front bi-fold corner web panel 52*a*, 52*b* separated by an angled fold line 52*c* and a side edge 50*a* of the rear panel 50 and a rear edge 44*b* of the first side panel 44 are connected to one another by a rear bi-fold corner web panel 54*a*, 54*b* separated by an angled fold line 54*c*. In compartment portion 40, the front corner panel portion 52*b* and the rear corner panel portion 54*b* serve as glue tabs for securement to the interior surface of side panel 44.

In the blank 10, the first side panel 24 of the first compartment portion 20 has front and rear glue tabs 36 and 38 that are foldably connected to respective front and rear edges 24*a* and 24*b* of the first side panel 24 for securement to interior surfaces of the front and rear panels 28 and 30 of the first compartment portion 20. Similarly, the second side panel 46 of the second compartment portion 40 has front and rear glue tabs 56 and 58 that are foldably connected to respective front and rear edges 46*a* and 46*b* of the second side panel 46 for securement to interior surfaces of the front and rear panels 48 and 50 of the second compartment portion 40.

Figure 3:
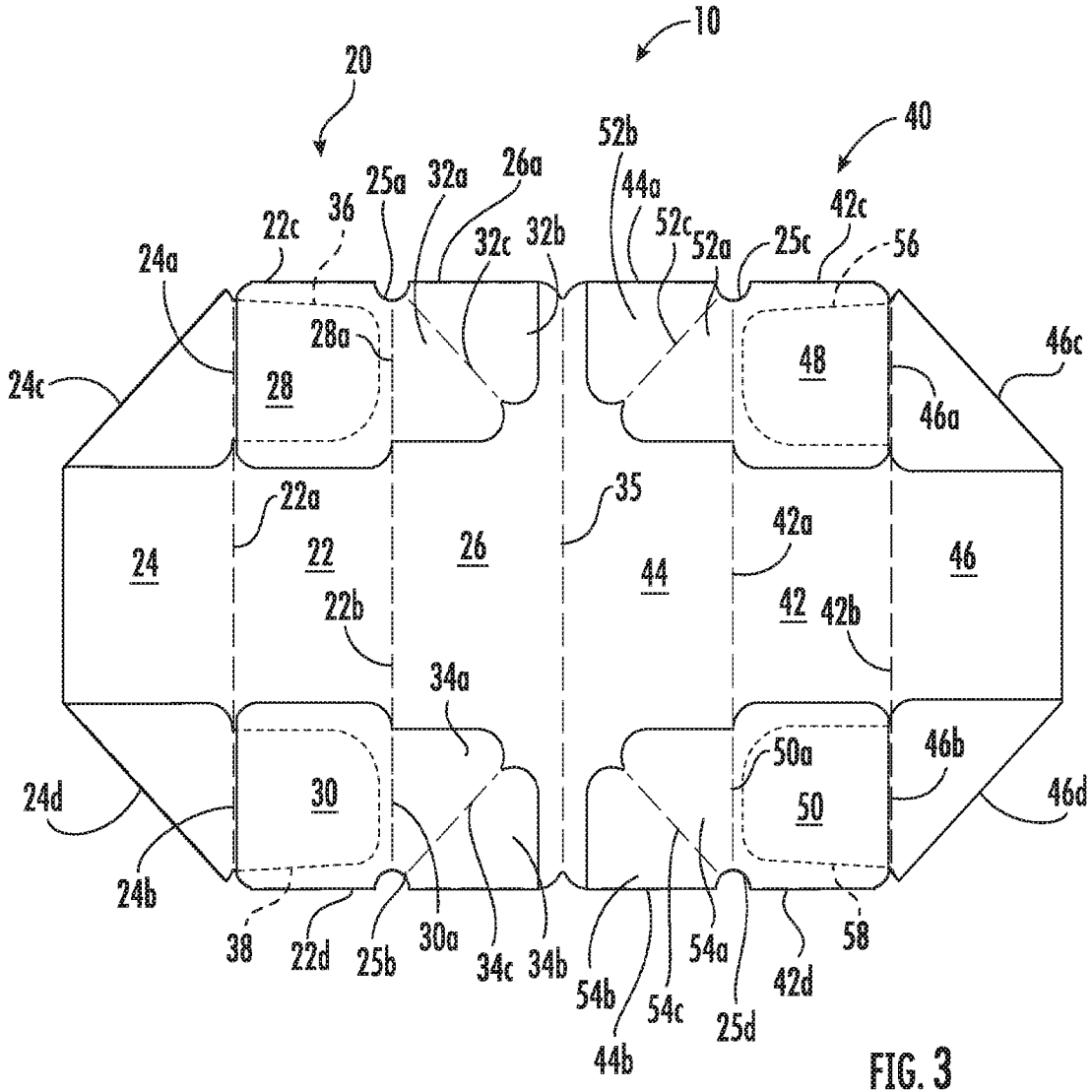
FIG. 3 is a perspective view of tray formed from the blank of FIG. 2 in glued and flattened condition for bulk shipping.

Referring to FIG. 3, to construct the tray 100 from the blank 10 the front and rear glue tabs 36 and 38 of the first side panel 24 are glued or otherwise secured to interior surfaces of the front and rear panels 28 and 30 of the first compartment portion 20, and the front and rear glue tabs 56 and 58 of the second side panel 46 are glued or otherwise secured to interior surfaces of the front and rear panels 48 and 50 of the second compartment portion 40. To aide in this part of the tray construction process, angled working scores 24*c* and 24*d* are formed in side panel 24 of compartment portion 20 and angled working scores 46*a* and 46*d* are formed in side panel 46 of compartment portion 40. The working scores enable the side panels 24 and 46 to be folded into a condition so that adhesive can be readily applied to the interior surfaces of the glue tabs.

To further construct the tray 100 from the blank 10, in compartment portion 20, the front corner panel portion 32*b* and the rear corner panel portion 34*b* are glued or otherwise secured to the interior surface of side panel 26, and in compartment portion 40, the front corner panel portion 52*b* and the rear corner panel portion 54*b* are glued or otherwise secured to the interior surface of side panel 44. Working score lines are preferably provided in blank 10 to aide this part of the tray construction process.

Figure 4:
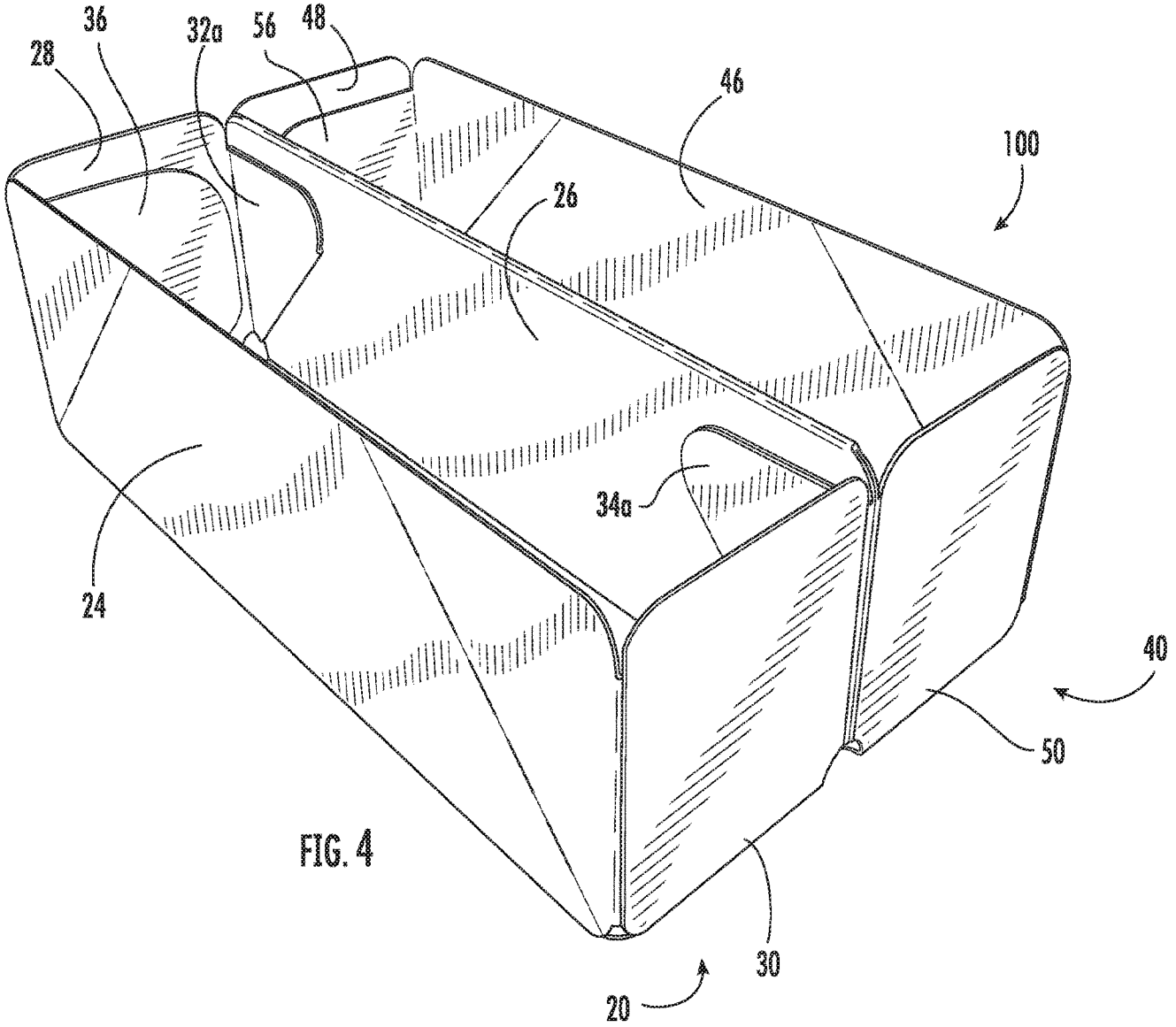
FIG. 4 is a perspective view of the tray formed from the blank of FIG. 2 in a fully erected condition.

In the glued and flattened condition shown in FIG. 3, a plurality of trays 100 can be packaged and shipped together in bulk format and then separately erected either manually or by machine at a product packaging facility so that they are in the fully erected condition shown in FIG. 4.

To aide in the erection of the tray 100 from the glued and flattened condition shown in FIG. 3 to the fully erected condition shown in FIG. 4, four oval strip out holes 23*a*-23*d* are provided that allow for the insertion of machine guided pins or the like that can serve to pop-out the side panels of the tray. In addition, four circular strip out holes 25*a*-25*d* are associated with the bottom panels 22 and 42 of compartment portions 20 and 40 to remove any sharp corners of the tray that could tear or penetrate the outer wrap or enclosure 110 of the finished product package shown for example in FIG. 1.

Figure 5:
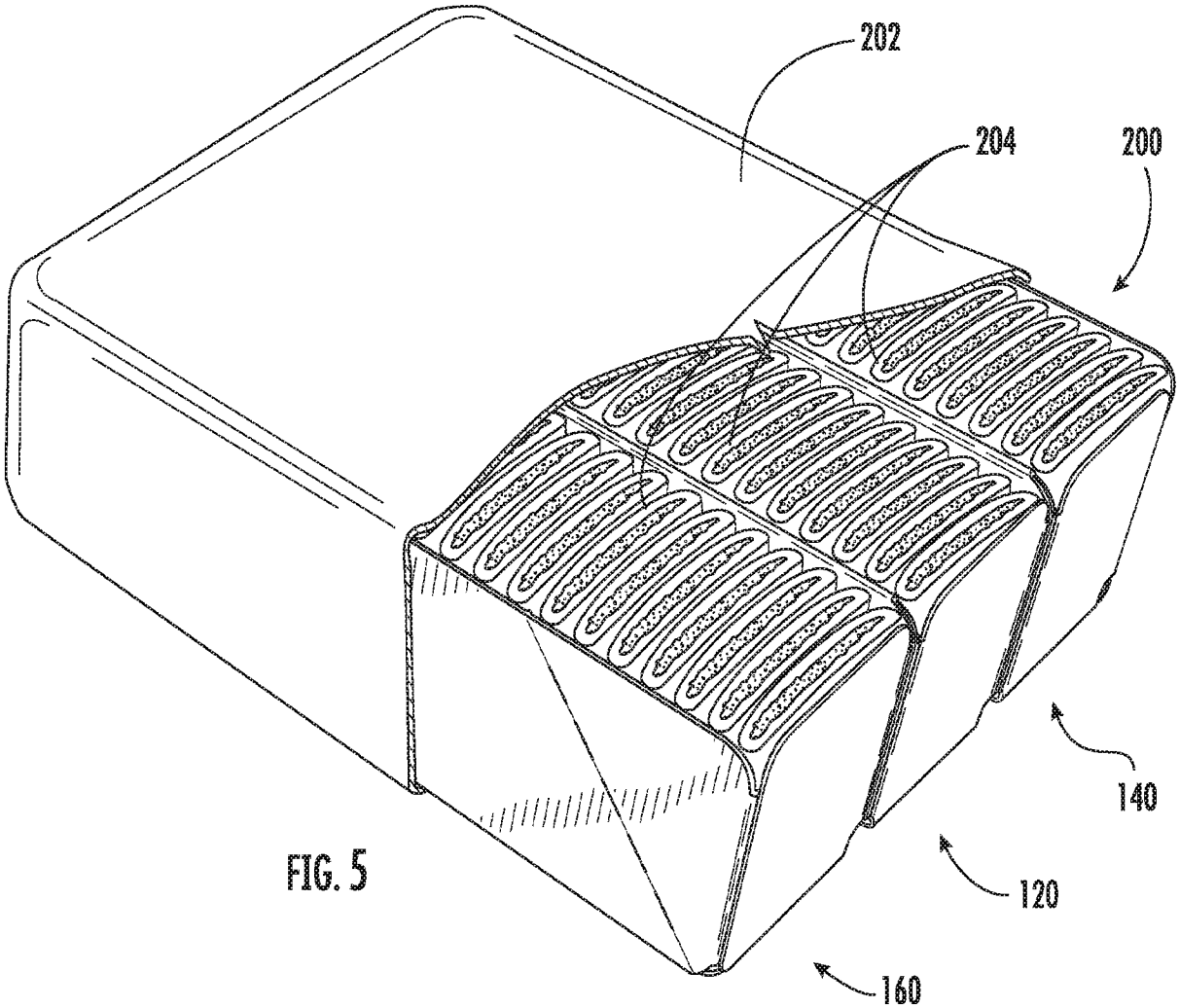
FIG. 5 is a perspective view of another embodiment of the tray of the subject invention, which has three divided compartments, and which is shown containing products and enclosed within a package.

Referring now to FIG. 5, there is illustrated a compartmented tray 200 contained within a packaging enclosure 202 and having three compartment portions 120, 140 and 160 for packaging food products such as cookies 204 or the like. The compartmented tray 200 can be erected manually or by a machine using a die cut paper or paperboard blank 110, which is illustrated in FIG. 6.

Figure 6:
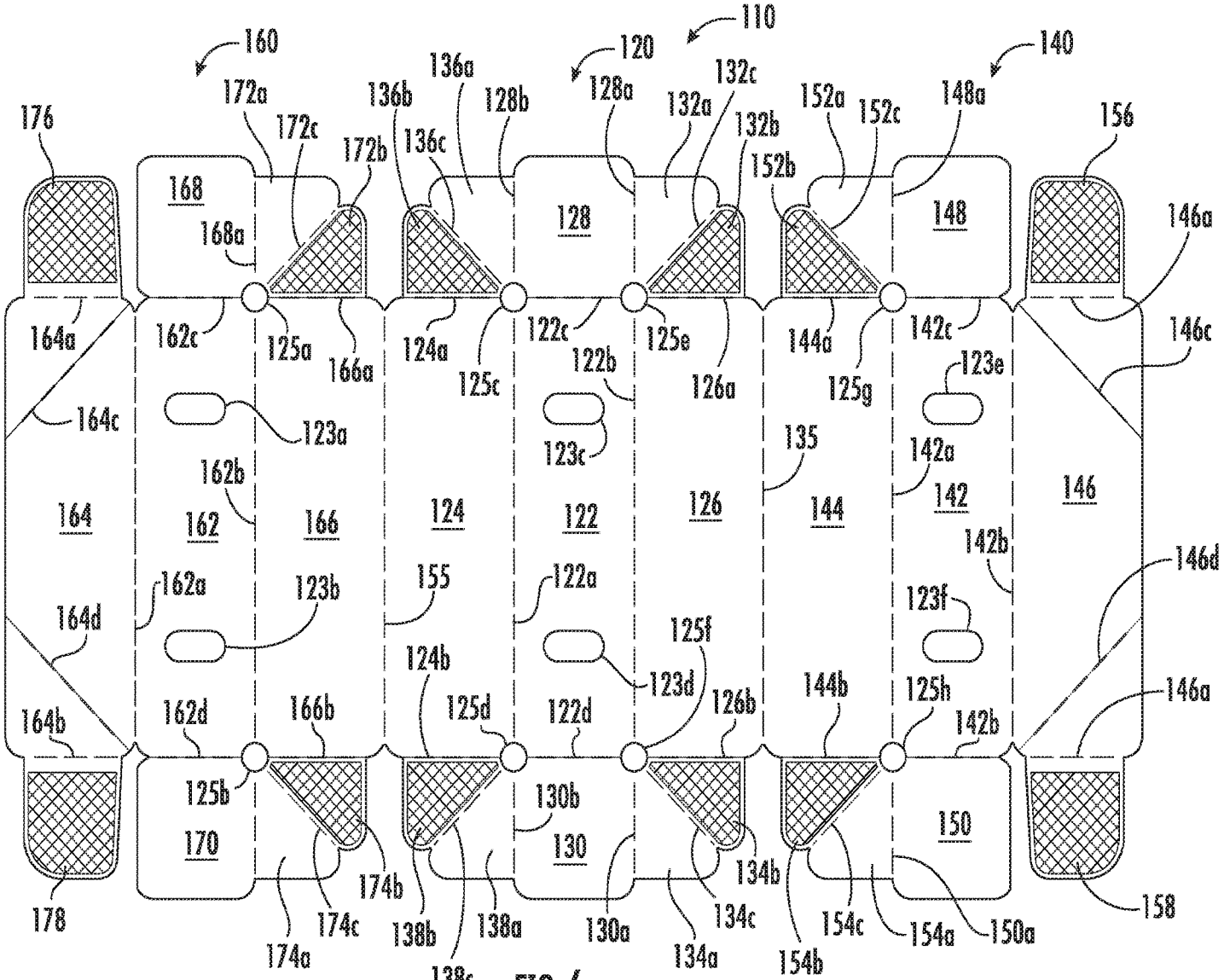
FIG. 6 is a top plan view of a blank for forming the tray of FIG. 5.

Referring now to FIG. 6, the blank 110 includes first compartment portion 120 which has a bottom panel 122, a first side panel 124 foldably connected to a first side edge 122*a* of the bottom panel 122, a second side panel 126 foldably connected to a second side edge 122*b* of the bottom panel 122, a front panel 128 foldably connected to a front edge 122*c* of the bottom panel 122 and a rear panel 130 foldably connected to a rear edge 122*d* of the bottom panel 122.

A first side edge 128*a* of the front panel 128 and a front edge 126*a* of the second side panel 126 are connected to one another by a front bi-fold corner web panel 132*a*, 132*b* separated by an angled fold line 132*c*. Similarly, a side edge 130*a* of the rear panel 130 and a rear edge 126*b* of the second side panel 126 are connected to one another by a rear bi-fold corner web panel 134*a*, 134*b* separated by an angled fold line 134*c*.

A second side edge 128*b* of the front panel 128 and a front edge 124*a* of the first side panel 124 are connected to one another by a front bi-fold corner web panel 136*a*, 136*b* separated by an angled fold line 136*c*. Similarly, a side edge 130*a* of the rear panel 130 and a rear edge 124*b* of the second side panel 124 are connected to one another by a rear bi-fold corner web panel 138*a*, 138*b* separated by an angled fold line 138*c*.

In compartment portion 120, the front corner panel portion 132*b* and the rear corner panel portion 134*b* serve as glue tabs for securement to the interior surface of side panel 126, and the front corner panel portion 136*b* and the rear corner panel portion 138*b* serve as glue tabs for securement to the interior surface of side panel 124.

The second compartment portion 140 of blank 110 has a bottom panel 142, a first side panel 144 foldably connected to a first side edge 142*a* of the bottom panel 142 and foldably connected to the second side panel 126 of the first compartment portion 120 along an adjoining fold line 135, a second side panel 146 foldably connected to a second side edge 142*b* of the bottom panel 142, a front panel 148 foldably connected to a front edge 142*c* of the bottom panel 142 and a rear panel 150 foldably connected to a rear edge 142*d* of the bottom panel 142.

A side edge 148*a* of the front panel 148 and a top edge 144*a* of the first side panel 144 are connected to one another by a front bi-fold corner web panel 152*a*, 152*b* separated by an angled fold line 152*c*. Similarly, a side edge 150*a* of the rear panel 150 and a rear edge 144*b* of the first side panel 144 are connected to one another by a rear bi-fold corner web panel 154*a*, 154*b* separated by an angled fold line 154*c*. In compartment portion 140, the front corner panel portion 152*b* and the rear corner panel portion 154*b* serve as glue tabs for securement to interior surfaces of side panel 144.

In the blank 110, the second side panel 146 of the second compartment portion 140 has front and rear glue tabs 156 and 158 that are foldably connected to respective front and rear edges 146*a* and 146*b* of the second side panel 146 for securement to interior surfaces of the front and rear panels 148 and 150 of the second compartment portion 140, The blank 110 further includes a third compartment portion 160 having a bottom panel 162, a first side panel 164 foldably connected to a first side edge 162*a* of the bottom panel 162, a second side panel 166 foldably connected to a second side edge 162*b* of the bottom panel 162 and foldably connected to the first side panel 124 of the first compartment portion 120 along an adjoining fold line 155, a front panel 168 foldably connected to a front edge 162*c* of the bottom panel 162 and a rear panel 170 foldably connected to a rear edge 162*d* of the bottom panel 162.

A side edge 168*a* of the front panel 168 and a front edge 166*a* of the second side panel 166 are connected to one another by a front bi-fold corner panel 172*a*, 172*b* separated from one another by an angled fold line 172*c*. A side edge 170*a* of the rear panel 170 and a rear edge 162*d* of the second side panel 162 are connected to one another by a rear bi-fold corner panel 174*a*, 174*b* separated from one another by an angled fold line 174*c*.

In compartment portion 160, the front corner panel portion 172*b* and the rear corner panel portion 174*b* serve as glue tabs for securement to interior surfaces of side panel 166. In addition, the first side panel 164 of the third compartment portion 160 has front and rear glue tabs 176 and 178 that are foldably connected to respective front and rear edges 164*a* and 164*b* of the first side panel 164 for securement to interior surfaces of the front and rear panels 168 and 170 of the third compartment portion 160.

Figure 7:
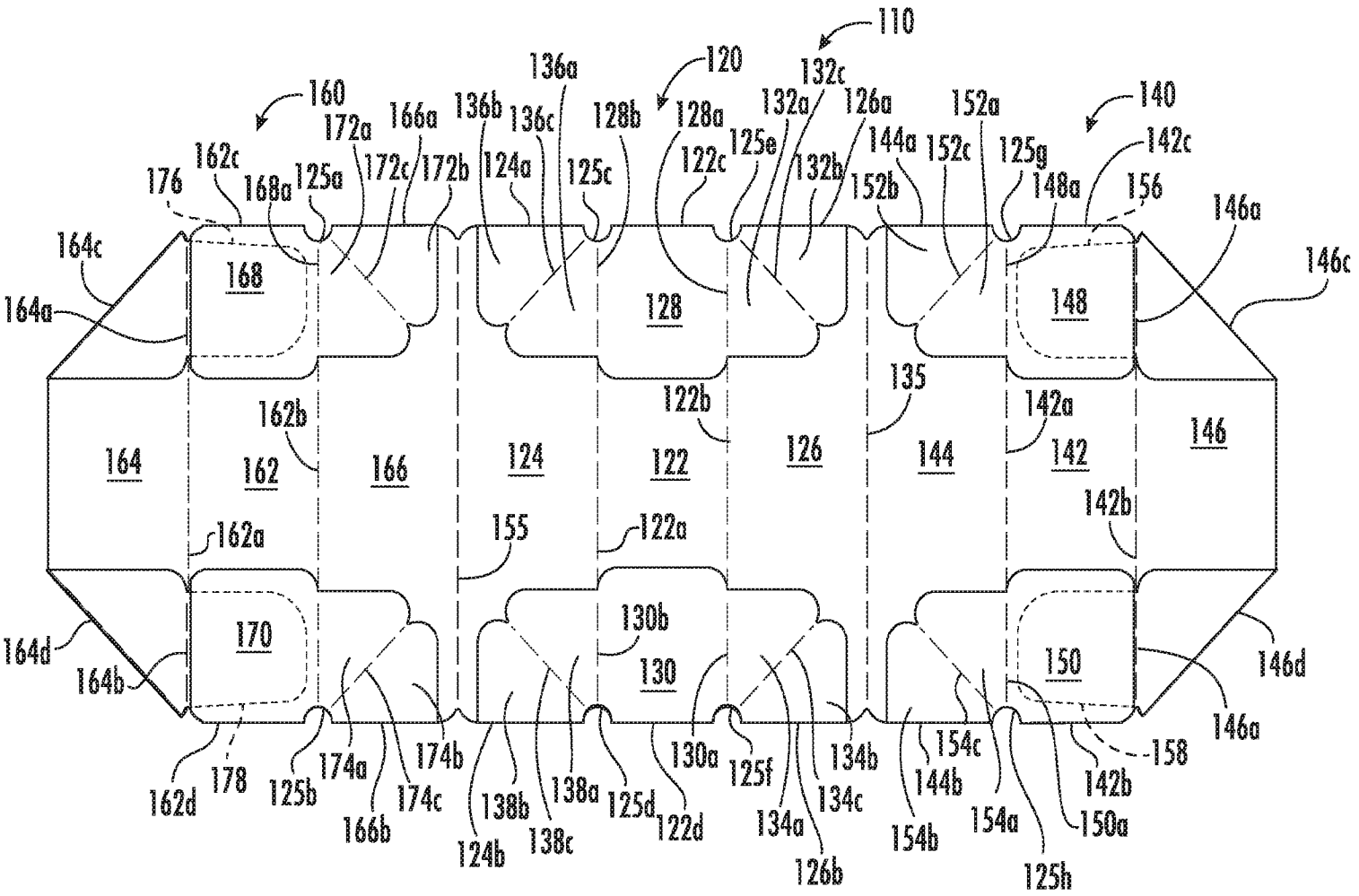
FIG. 7 is a perspective view of tray formed from the blank of FIG. 5 in glued and flattened condition for bulk shipping.

Referring to FIG. 7, to construct the tray 200 from the blank 110 the front and rear glue tabs 156 and 158 of side panel 146 are glued or otherwise secured to interior surfaces of the front and rear panels 148 and 150 of the second compartment portion 140, and the front and rear glue tabs 176 and 178 of side panel 164 are glued or otherwise secured to interior surfaces of the front and rear panels 168 and 170 of the third compartment portion 160. To aide in this part of the tray construction process, angled working scores 164*c* and 164*d* are formed in side panel 164 of compartment portion 160 and angled working scores 146*c* and 146*d* are formed in side panel 146 of compartment portion 140. The working scores enable the side panels 164 and 146 to be folded into a condition so that adhesive can be readily applied to the interior surfaces of the glue tabs.

To further construct the tray 200 from the blank 110, in compartment portion 120, the front corner panel portion 132*b* and the rear corner panel portion 134*b* are glued or otherwise secured to the interior surface of side panel 126, the front corner panel portion 136*b* and the rear corner panel portion 138*b* are glued or otherwise secured to the interior surface of side panel 124. Similarly, in compartment portion 140, the front corner panel portion 152*b* and the rear corner panel portion 154*b* are glued or otherwise secured to the interior surface of side panel 144, and in compartment portion 160 the front corner panel portion 172*b* and the rear corner panel portion 174*b* are glued or otherwise secured to the interior surface of side panel 166. Working score lines are preferably provided in the blank 110 to aide this part of the tray construction process.

Figure 8:
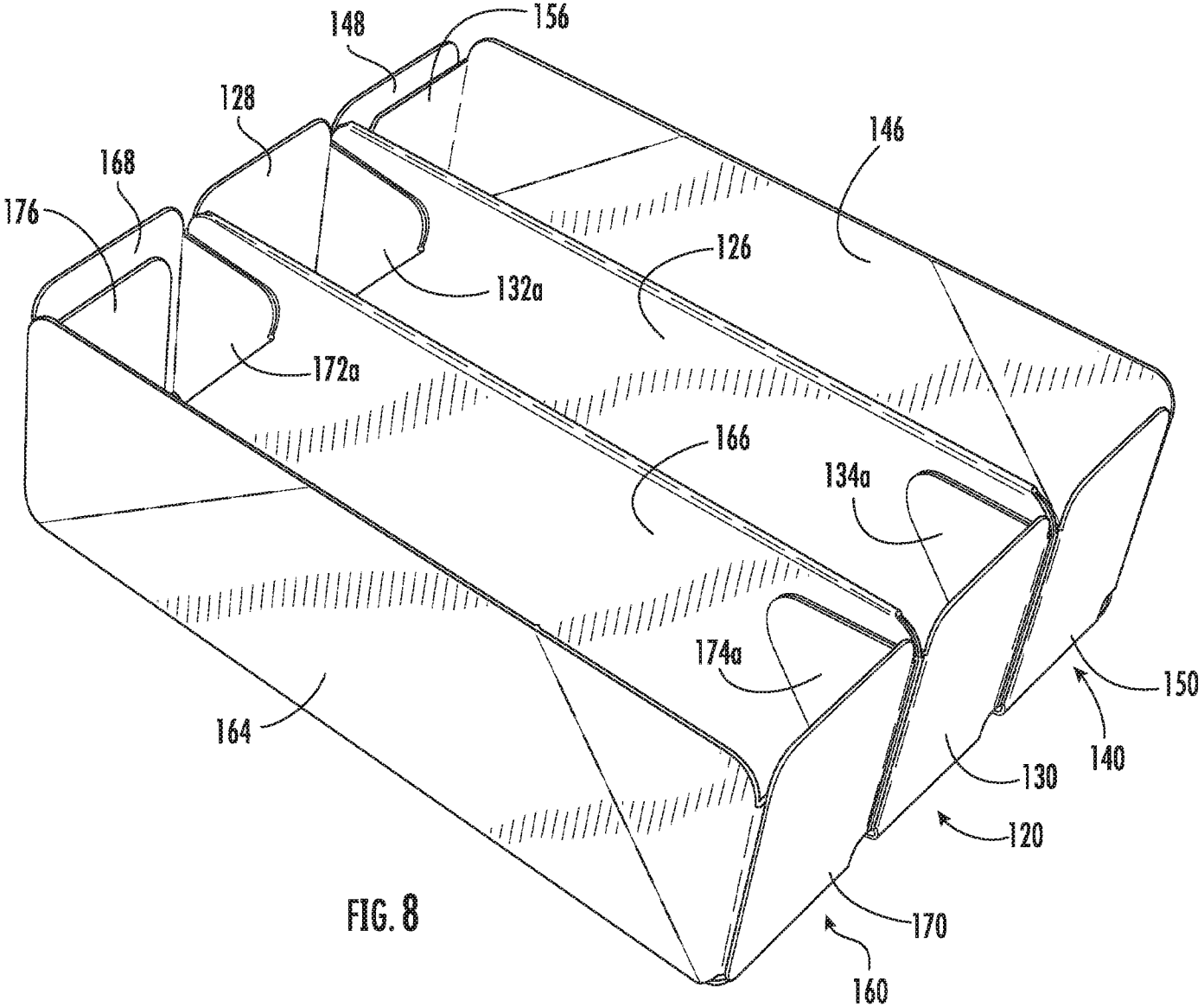
FIG. 8 is a perspective view of the tray formed from the blank of FIG. 5 in a fully erected condition.

In this glued and flattened condition shown in FIG. 7, a plurality of trays 200 can be packaged and shipped together in bulk format and then separately erected either manually or by machine at a product packaging facility so that they are in the fully erected condition shown in FIG. 8.

To aide in the erection of the tray 200 from the glued and flattened condition shown in FIG. 7 to the fully erected condition shown in FIG. 8, six oval strip out holes 123*a*-123*f* are provided that allow for the insertion of machine guided pins or the like that can serve to pop-out the side panels of the tray. In addition, eight circular strip out holes 125*a*-125*h* are associated with the bottom panels 122, 142 and 162 of compartment portions 120, 140 and 160 to remove any sharp corners of the tray that could tear or penetrate the outer wrap or enclosure 210 of the finished product package shown for example in FIG. 5.

While the subject disclosure has been shown and described with reference to preferred embodiments, those skilled in the art will readily appreciate that changes or modifications may be made thereto without departing from the spirit or scope of the subject disclosure.

What is claimed is:

1. A blank for constructing a tray having divided compartments, comprising:

a) a first compartment portion having a bottom panel, a first side panel foldably connected to a first side edge of the bottom panel, a second side panel foldably connected to a second side edge of the bottom panel, a front panel foldably connected to a front edge of the bottom panel and a rear panel foldably connected to a rear edge of the bottom panel, wherein a side edge of the front panel and a front edge of the second side panel are connected to one another by a front bi-fold corner panel and a side edge of the rear panel and a rear edge of the second side panel are connected to one another by a rear bi-fold corner panel; and a) a second compartment portion having a bottom panel, a first side panel foldably connected to a first side edge of the bottom panel and foldably connected to the second side panel of the first compartment portion along an adjoining fold line, a second side panel foldably connected to a second side edge of the bottom panel, a front panel foldably connected to a front edge of the bottom panel and a rear panel foldably connected to a rear edge of the bottom panel, wherein a side edge of the front panel and a top edge of the first side panel are connected to one another by a front bi-fold corner panel and a side edge of the rear panel and a rear edge of the first side panel are connected to one another by a rear bi-fold corner panel, wherein a panel portion of each of the front bi-fold corner panel and the rear bi-fold corner panel that is foldably connected to an edge of the first side panel or the second side panel serves as a glue tab with respect to an interior surface of that side panel.

2. A blank as recited in claim 1, wherein the first side panel of the first compartment portion has front and rear glue tabs foldably connected to respective front and rear edges thereof for securement to interior surfaces of the front and rear panels of the first compartment portion.

3. A blank as recited in claim 1, wherein the second side panel of the second compartment portion has front and rear glue tabs foldably connected to respective front and rear edges thereof for securement to interior surfaces of the front and rear panels of the second compartment portion.

4. A blank as recited in claim 1, wherein a second side edge of the front panel of the first compartment portion and a front edge of the first side panel of the first compartment portion are connected to one another by a front bi-fold corner panel and a second side edge of the rear panel and a rear edge of the first side panel of the first compartment portion are connected to one another by a rear bi-fold corner panel.

5. A blank as recited in claim 4, further comprising a third compartment portion having a bottom panel, a first side panel foldably connected to a first side edge of the bottom panel, a second side panel foldably connected to a second side edge of the bottom panel and foldably connected to the first side panel of the first compartment portion along an adjoining fold line, a front panel foldably connected to a front edge of the bottom panel and a rear panel foldably connected to a rear edge of the bottom panel, wherein a side edge of the front panel and a front edge of the second side panel are connected to one another by a front bi-fold corner panel and a side edge of the rear panel and a rear edge of the second side panel are connected to one another by a rear bi-fold corner panel.

6. A blank as recited in claim 5, wherein the first side panel of the third compartment portion has front and rear glue tabs foldably connected to respective front and rear edges thereof for securement to interior surfaces of the front and rear panels of the third compartment portion.

7. A blank as recited in claim 1, wherein the blank is formed from a paper board material.

8. A blank as recited in claim 1, wherein strip out holes are associated with the bottom panel of each compartment portion to remove shape corners from the tray.

9. A blank as recited in claim 1, wherein angled working scores are provided on two side panels to enable the blank to be glued into a flattened condition.

10. A tray as recited in claim 1, wherein angled working scores are provided on two side panels to enable the tray to be erected from a flattened condition.

11. A tray having divided compartments, comprising:

a) a first compartment portion having a bottom panel, a first side panel foldably connected to a first side edge of the bottom panel, a second side panel foldably connected to a second side edge of the bottom panel, a front panel foldably connected to a front edge of the bottom panel and a rear panel foldably connected to a rear edge of the bottom panel, wherein a side edge of the front panel and a front edge of the second side panel are connected to one another by a front bi-fold corner panel and a side edge of the rear panel and a rear edge of the second side panel are connected to one another by a rear bi-fold corner panel; and a) a second compartment portion having a bottom panel, a first side panel foldably connected to a first side edge of the bottom panel and foldably connected to the second side panel of the first compartment portion along an adjoining fold line, a second side panel foldably connected to a second side edge of the bottom panel, a front panel foldably connected to a front edge of the bottom panel and a rear panel foldably connected to a rear edge of the bottom panel, wherein a side edge of the front panel and a top edge of the first side panel are connected to one another by a front bi-fold corner panel and a side edge of the rear panel and a rear edge of the first side panel are connected to one another by a rear bi-fold corner panel, wherein a panel portion of each of the front bi-fold corner panel and the rear bi-fold corner panel that is foldably connected to an edge of the first side panel or the second side panel serves as a glue tab with respect to an interior surface of that side panel.

12. A tray as recited in claim 11, wherein the first side panel of the first compartment portion has front and rear glue tabs foldably connected to respective front and rear edges thereof and secured to interior surfaces of the front and rear panels of the first compartment portion.

13. A tray as recited in claim 11, wherein the second side panel of the second compartment portion has front and rear glue tabs foldably connected to respective front and rear edges thereof and secured to interior surfaces of the front and rear panels of the second compartment portion.

14. A tray as recited in claim 11, wherein a second side edge of the front panel of the first compartment portion and a front edge of the first side panel of the first compartment portion are connected to one another by a front bi-fold corner panel and a second side edge of the rear panel and a rear edge of the first side panel of the first compartment portion are connected to one another by a rear bi-fold corner panel.

15. A tray as recited in claim 14, further comprising a third compartment portion having a bottom panel, a first side panel foldably connected to a first side edge of the bottom panel, a second side panel foldably connected to a second side edge of the bottom panel and foldably connected to the first side panel of the first compartment portion along an adjoining fold line, a front panel foldably connected to a front edge of the bottom panel and a rear panel foldably connected to a rear edge of the bottom panel, wherein a side edge of the front panel and a front edge of the second side panel are connected to one another by a front bi-fold corner panel and a side edge of the rear panel and a rear edge of the second side panel are connected to one another by a rear bi-fold corner panel.

16. A tray as recited in claim 15, wherein the first side panel of the third compartment portion has front and rear glue tabs foldably connected to respective front and rear edges thereof and secured to interior surfaces of the front and rear panels of the third compartment portion.

17. A tray as recited in claim 15, wherein a panel portion of each bi-fold corner panel that is foldably connected to an edge of a side panel serves as a glue tab with respect to an interior surface of that side panel.

18. A tray as recited in claim 11, wherein the tray is formed from a blank of paper board material.

19. A tray as recited in claim 11, wherein strip out holes are associated with the bottom panel of each compartment portion to remove shape corners from the tray.

* * * * *